US008520473B2

(12) United States Patent
Honda

(10) Patent No.: US 8,520,473 B2
(45) Date of Patent: Aug. 27, 2013

(54) ELECTRONIC DEVICE AND SATELLITE SIGNAL RECEPTION METHOD FOR AN ELECTRONIC DEVICE

(75) Inventor: Katsuyuki Honda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 803 days.

(21) Appl. No.: 12/713,525

(22) Filed: Feb. 26, 2010

(65) Prior Publication Data

US 2010/0220555 A1 Sep. 2, 2010

(30) Foreign Application Priority Data

Mar. 2, 2009 (JP) ..... 2009-048313

(51) Int. Cl.
*G04B 47/00* (2006.01)

(52) U.S. Cl.
USPC ..... 368/14; 368/47

(58) Field of Classification Search
USPC ..... 368/14, 47; 342/357.65
See application file for complete search history.

(56) References Cited

U.S. PATENT DOCUMENTS

| | | | | |
|---|---|---|---|---|
| 6,205,091 | B1 * | 3/2001 | Rudolph et al. | 368/205 |
| 7,307,919 | B2 * | 12/2007 | Fujisawa et al. | 368/47 |
| 7,612,735 | B2 * | 11/2009 | Essig et al. | 343/915 |
| 7,616,153 | B2 * | 11/2009 | Honda et al. | 342/357.74 |
| 7,649,812 | B2 * | 1/2010 | Baba | 368/47 |
| 8,116,170 | B2 * | 2/2012 | Matsuzaki | 368/47 |
| 2008/0030403 | A1 * | 2/2008 | Honda et al. | 342/357.01 |

FOREIGN PATENT DOCUMENTS

| | | |
|---|---|---|
| EP | 1 884 753 A1 | 2/2008 |
| EP | 2 063 329 A1 | 5/2009 |
| EP | 2 073 081 A1 | 6/2009 |
| EP | 2 081 091 A1 | 7/2009 |
| JP | 2008-039565 | 2/2008 |

* cited by examiner

*Primary Examiner* — Sean Kayes

(57) ABSTRACT

An electronic device has a reception unit that captures positioning information satellites and receives satellite signals transmitted from the captured positioning information satellites, a solar panel, and a reception control unit that controls the reception unit. The reception control unit includes an evaluation unit that evaluates the reception environment based on power generation by the solar panel, and a mode selection unit that, based on the result from the evaluation unit, selects a time information reception mode for receiving the satellite signals and acquiring time information, or a position and time information reception mode for receiving the satellite signals and acquiring positioning information and time information, and controls operation of the reception unit in the reception mode selected by the mode selection unit.

9 Claims, 13 Drawing Sheets

ELECTRONIC DEVICE AND SATELLITE SIGNAL RECEPTION METHOD FOR AN ELECTRONIC DEVICE

CROSS-REFERENCE TO RELATED APPLICATION(S)

Japanese Patent application No. 2009-048313 is hereby incorporated by reference in its entirety.

BACKGROUND

1. Field of Invention

The present invention relates to an electronic device and to a satellite signal reception method for an electronic device that receives satellite signals sent from positioning information satellites such as GPS satellites and acquires current position and time information.

2. Description of Related Art

The Global Positioning System (GPS) for determining the position of a GPS receiver uses GPS satellites that circle the Earth on known orbits, and each GPS satellite has an atomic clock on board. Each GPS satellite therefore keeps the time (referred to below as the GPS time or satellite time information) with extremely high precision. This has led to the development of electronic timepieces that adjust the time kept internally using time information (GPS time information) received from a GPS satellite.

However, because the signals from a GPS satellite are highly directional microwave signals, the satellite signal cannot be received if there is an obstruction between the GPS satellite and the electronic timepiece or other electronic device that receives signals from the satellite. Receiving signals from a GPS satellite is particularly difficult if the electronic device is indoors surrounded by a ceiling and walls, for example.

If the reception process is executed in such an environment, power consumption increases without being able to receive the satellite signal. This is particularly a problem with a battery-powered electronic device such as a wristwatch because battery power is consumed needlessly and the duration time of the battery is thus shortened.

Japanese Unexamined Patent Appl. Pub. JP-A-2008-39565 therefore teaches an electronic device that can prevent needless power consumption by determining whether the electronic device is indoor or outdoor, executing the reception operation if the electronic device is outdoor, and not executing the reception operation if the electronic device is indoor.

The technology taught in JP-A-2008-39565, however, simply decides to execute or not execute the reception operation by deciding if the electronic device is indoor or outdoor, and receiving satellite signals efficiently can be difficult.

More particularly, if the electronic device is a wristwatch that is worn by the user and is determined to be outdoor, the reception operation will execute and continue executing even if the reception environment is actually quite poor because, for example, the user is moving, such as walking through the city, resulting in the orientation of the electronic device changing and the electronic device even moving into the shadow of a building where reception is not possible.

SUMMARY OF INVENTION

An electronic device and a satellite signal reception method for an electronic device according to the present invention can suitably detect the reception environment of the electronic device, control the reception operation accordingly, and execute the reception process efficiently.

A first aspect of the invention is an electronic device having a reception unit that captures positioning information satellites and receives satellite signals transmitted from the captured positioning information satellites; a solar panel; and a reception control unit that controls the reception unit. The reception control unit includes an evaluation unit that evaluates the reception environment based on power generation by the solar panel, and a mode selection unit that, based on the result from the evaluation unit, selects a time information reception mode for receiving the satellite signals and acquiring time information, or a position and time information reception mode for receiving the satellite signals and acquiring positioning information and time information, and controls operation of the reception unit in the reception mode selected by the mode selection unit.

Power generation by the solar panel is lower indoors where there is no illumination from sunlight, and is higher outdoor, even on a cloudy day, where there is sunlight. The evaluation unit can therefore determine during the day when the sun is out whether the electronic device is currently indoor or outdoor based on power generation by the solar panel.

If the evaluation unit determines the electronic device is indoors, the satellite signal reception environment is poor compared to being outdoor, and the mode selection unit therefore selects the time information reception mode, which can be processed using signals received from only one satellite. However, if the evaluation unit determines the electronic device is outdoors, the mode selection unit selects the position and time information reception mode, which requires receiving satellite signals from three or more positioning information satellites for processing.

With this aspect of the invention, because the evaluation unit thus evaluates the reception environment based on power generation by the solar panel, the mode selection unit can appropriately select either the time information reception mode or the position and time information reception mode as the reception mode suitable to the reception environment.

As a result, because the position and time information reception mode, which requires capturing plural positioning information satellites and receiving signals from each satellite, is executed only when the electronic device is determined to be outdoor in a good reception environment, the satellite signals can be received efficiently, power consumption can be reduced, and battery life can be extended.

In addition, because the reception environment is evaluated using the power produced by a solar panel that can be used as a power supply, the parts count is smaller than in a configuration that uses dedicated parts to evaluate the reception environment, and the electronic device can therefore be made smaller and the cost reduced.

Furthermore, while solar panel power output is greatest when facing the sun and stationary, the orientation of the solar panel can change or the solar panel may enter the shadow of a building and power generation can drop even during the day. Therefore, in addition to determining if the electronic device is outdoor, whether the solar panel is stationary and not hidden in the shadow of a building, that is, the reception environment is good, or whether the orientation of the solar panel changes or is hidden in the shadow of a building, that is, the reception environment is not particularly good, can also be determined by checking the power output of the solar panel. The evaluation unit can therefore accurately evaluate the reception environment, and the mode selection unit can select the most appropriate reception mode.

Further preferably in an electronic device according to another aspect of the invention, the evaluation unit monitors power generation by the solar panel for a specified change monitoring time, and determines if the change in power generation during the change monitoring time is greater than or equal to change evaluation threshold value, and the mode selection unit selects the time information reception mode when the evaluation unit determines that the change in power generation was greater than or equal to the change evaluation threshold value, and selects the position and time information reception mode when the evaluation unit determines that the change in power generation was less than the change evaluation threshold value.

This change monitoring time may be set to any time that enables determining the change in power generation by the solar panel, and is set to approximately 10-20 seconds, for example.

If the change in power generation is great and exceeds a change evaluation threshold value, the orientation of the electronic device is likely changing. For example, if the electronic device is a wristwatch and the user is holding the wristwatch still, the orientation of the solar panel is constant and the change in power generation is small. In this situation, change in the orientation and position of the electronic device relative to the positioning information satellites can be expected to be small, and the reception environment can be determined to be good.

However, if the user is walking while wearing the wristwatch, the change in power generation will increase because the orientation of the wristwatch changes greatly as the user wearing the wristwatch moves in and out of the shadows of buildings while walking and the arms swing while walking. In this situation the orientation and position of the electronic device relative to the positioning information satellites can be expected vary greatly, the satellite signals may even be blocked by buildings, and the reception environment can be determined to be not particularly good.

Therefore, if the reception mode is selected based on the change in power generation, a reception mode suitable to the reception environment can be selected, and signals can be received efficiently. Power consumption can also be reduced, and battery life can be extended.

Further preferably in an electronic device according to another aspect of the invention, the evaluation unit determines if power generation by the solar panel is greater than or equal to a power generation evaluation threshold value, and the mode selection unit selects the position and time information reception mode when the evaluation unit determines that power generation is greater than or equal to the power generation evaluation threshold value, and selects the time information reception mode when the evaluation unit determines that power generation is less than the power generation evaluation threshold value.

When power generation is greater than or equal to the power generation evaluation threshold value, the electronic device can be expected to be outdoor and the reception environment good, and the reception process can be executed efficiently even in the position and time information reception mode.

However, because the electronic device can be expected to be indoors and the reception environment not particularly good if power generation is less than the power generation evaluation threshold value, the reception process can be executed efficiently by selecting the time information reception mode, that is, the reception mode in which reception is possible even in this reception environment.

The evaluation unit can therefore easily determine the reception environment by comparing power generation with a power generation evaluation threshold value, the mode selection unit can select the reception mode according to the reception environment, and efficient reception is possible. As a result, power consumption can also be reduced, and battery life can be extended.

Further preferably in an electronic device according to another aspect of the invention, the evaluation unit determines if power generation by the solar panel is greater than or equal to a first power generation evaluation threshold value, is less than a second power generation evaluation threshold value that is lower than the first power generation evaluation threshold value, or is less than the first power generation evaluation threshold value and greater than or equal to the second power generation evaluation threshold value. The mode selection unit selects the position and time information reception mode when the evaluation unit determines power generation is greater than or equal to the first power generation evaluation threshold value, selects the time information reception mode when the evaluation unit determines power generation is less than the first power generation evaluation threshold value and greater than or equal to the second power generation evaluation threshold value, and changes to a mode enabling the user to select the reception mode when the evaluation unit determines power generation is less than the second power generation evaluation threshold value.

In this aspect of the invention, when power generation is greater than or equal to the first power generation evaluation threshold value, the electronic device can be expected to be outdoor and the reception environment good, and the reception process can be executed efficiently even if the reception process is executed in the position and time information reception mode.

If power generation is less than the first power generation evaluation threshold value and greater than or equal to the second power generation evaluation threshold value, the electronic device can be expected to be indoors and the reception process can be executed efficiently by selecting the time information reception mode, that is, the reception mode in which reception is possible even in this reception environment.

Furthermore, if power generation is extremely low and is less than the second power generation evaluation threshold value, there is a strong possibility that the electronic device is outdoor at night or indoors with the lights turned off. By enabling the user to select the reception mode in this situation, efficient reception is possible even if the user selects the position and time information reception mode when the electronic device is outdoor where the reception environment is good at night. However, if the electronic device is indoors with the lights off, the reception process can be executed efficiently if the user selects the time information reception mode with appropriate consideration for the reception environment.

Further preferably in an electronic device according to another aspect of the invention, the reception control unit sets the time-out time when the mode selection unit selects the time information reception mode shorter than the time-out time set when the position and time information reception mode is selected.

Because the reception environment has been determined to be poor when the time information reception mode is selected, there is a good possibility that the electronic device is in an environment where signals cannot be received from even one positioning information satellite, such as on the subway or inside a building in a room with no windows.

Because a short time-out time is set when the time information reception mode is selected in this aspect of the invention, the reception process will not continue needlessly when in an environment where satellite signals cannot be received, and an increase in current consumption and shortened battery life can therefore be prevented.

Another aspect of the invention is an electronic device having a reception unit that captures positioning information satellites and receives satellite signals transmitted from the captured positioning information satellites, a solar panel, and a reception control unit that controls the reception unit. The reception control unit includes an evaluation unit that evaluates the reception environment based on power generation by the solar panel, and a time-out time setting unit that sets a time-out time based on the result from the evaluation unit, and causes the reception unit to stop and stops reception if the time-out time set by the time-out time setting unit is reached without reception succeeding after the reception unit is operated and reception started.

If it is daytime when the sun is out, the evaluation unit in this aspect of the invention can determine from the power generation of the solar panel whether the current location of the electronic device is indoor or outdoor.

If the evaluation unit determines it is indoors, satellite signal reception is more difficult than when outdoor, and the time-out time setting unit sets a short time-out time considering that reception is often not possible even with a long reception time. However, when the evaluation unit determines it is outdoor, the time-out time setting unit sets a longer time-out time considering the higher possibility that reception will succeed if reception continues for a certain length of time as a result of electronic device movement even if the electronic device is temporarily hidden in the shadow of a building where reception is not possible.

Because the evaluation unit determines the reception environment based on power generation by the solar panel, the time-out time setting unit in this aspect of the invention can appropriately set the time-out time suitably to the reception environment.

As a result, if it is determined that the electronic device is outdoor and the reception environment is good, even if a positioning information satellite cannot be captured at the beginning of reception, satellite signals can be efficiently received by increasing the time-out time because reception will be possible when the electronic device moves out of the building shadow.

However, if it is determined that the electronic device is indoors and the reception environment is not good, the likelihood is high that a positioning information satellite cannot be captured even if the reception process continues, and the reception process can therefore be prevented from needlessly continuing for a long time if the time-out time is shortened.

In addition, because the reception environment is evaluated using the power produced by a solar panel that can be used as a power supply, the parts count is smaller than in a configuration that uses dedicated parts to evaluate the reception environment, and the electronic device can therefore be made smaller and the cost reduced.

Therefore, in addition to determining if the electronic device is outdoor, whether the solar panel is stationary and not hidden in the shadow of a building, that is, the reception environment is good, or whether the orientation of the solar panel changes or is hidden in the shadow of a building, that is, the reception environment is not particularly good, can also be determined by checking the power output of the solar panel. The evaluation unit can therefore accurately evaluate the reception environment, and time-out time setting unit can set an appropriate time-out time.

Preferably in an electronic device according to another aspect of the invention, the evaluation unit determines if power generation by the solar panel is greater than or equal to a power generation evaluation threshold value, and the time-out time setting unit sets the time-out time to a first time when the evaluation unit determines power generation is greater than or equal to the power generation evaluation threshold value, and sets the time-out time to a second time that is shorter than the first time when the evaluation unit determines power generation is less than the power generation evaluation threshold value.

When power generation is greater than or equal to the power generation evaluation threshold value, the electronic device can be expected to be outdoor and the reception environment good. Therefore, even if some of the positioning information satellites are temporarily hidden by the shadow of a building and reception is not possible, the possibility of satellite signal reception succeeding is increased by setting the time-out time to a first time that is longer than the second time because the electronic device will likely move so that a positioning information satellite can be captured as a result of increasing the time-out time and continuing reception.

However, if power generation is less than the power generation evaluation threshold value, the electronic device can be expected to be indoors where the reception environment is not particularly good, and needlessly continuing the reception process for a long time can be prevented by setting the time-out time short.

The evaluation unit can therefore easily determine the reception environment by comparing power generation with a power generation evaluation threshold value, the time-out time setting unit can set the time-out time according to the reception environment, and efficient reception is possible. As a result, power consumption can also be reduced, and battery life can be extended.

In an electronic device according to another aspect of the invention, the evaluation unit monitors power generation by the solar panel for a specified change monitoring time, and determines if the change in power generation during the change monitoring time is greater than or equal to change evaluation threshold value; and the time-out time setting unit sets the time-out time to a first time when the evaluation unit determines that the change in power generation was less than the change evaluation threshold value, and sets the time-out time to a second time that is shorter than the first time when the evaluation unit determines that the change in power generation was greater than or equal to the change evaluation threshold value.

This change monitoring time may be set to any time that enables determining the change in power generation by the solar panel, and is set to approximately 10-20 seconds, for example.

If the change in power generation is great and exceeds a change evaluation threshold value, the orientation of the electronic device is likely changing. For example, if the electronic device is a wristwatch and the user is holding the wristwatch still, the orientation of the solar panel is constant and the change in power generation is small. In this situation, change in the orientation and position of the electronic device relative to the positioning information satellites can be expected to be small, and the reception environment can be determined to be good.

However, if the user is walking while wearing the wristwatch, the change in power generation will increase because the orientation of the wristwatch changes greatly as the user wearing the wristwatch moves in and out of the shadows of buildings while walking and the arms swing while walking. In this situation the orientation and position of the electronic device relative to the positioning information satellites can be expected vary greatly, the satellite signals may even be blocked by buildings, and the reception environment can be determined to be not particularly good.

Therefore, if the time-out time is set based on the change in power generation, a time-out time suitable to the reception environment can be set, and signals can be received efficiently. Power consumption can also be reduced, and battery life can be extended.

In an electronic device according to another aspect of the invention, the reception control unit operates the reception unit and starts the reception operation when power generation by the solar panel exceeds a preset power generation threshold value for greater than or equal to a specified outdoor determination time.

This outdoor determination time may be any time enabling determining that the electronic device moved outdoor, and may usually be set from several seconds to approximately 10 seconds.

In this aspect of the invention, when the electronic device moves from indoors to outdoor, for example, power generation by the solar panel increases. Therefore, if power generation exceeding the power generation threshold value continues for a specified outdoor determination time or longer, the electronic device can be expected to have moved completely outdoor and be located in a good reception environment. Therefore, if the reception operation starts automatically in this situation, automatic reception by the electronic device can always start in a good reception environment, the reception process can be executed efficiently during automatic reception, power consumption can be reduced, and battery life can be extended.

In an electronic device according to another aspect of the invention, the reception control unit does not start the reception operation when power generation by the solar panel exceeds a preset power generation threshold value for greater than or equal to a specified outdoor determination time if the time since the last successful reception operation is not greater than or equal to a preset reception interval time.

This reception interval time sets the shortest interval between reception operations, and may be set to 24 hours (1 day), for example.

In this aspect of the invention, if automatic reception starts when power generation exceeds the threshold value for at least the outdoor determination time, the reception process will be executed each time the user goes in and out of a building, and may therefore be executed plural times in a single day, and power consumption increases accordingly.

If the electronic device is a wristwatch, it is typically sufficient if the reception operation for setting the time executes at an interval of one day or more, and there is no need for the automatic reception process to execute plural times in a day.

However, because automatic reception does not execute in this aspect of the invention if the set reception interval time has not passed since the last successful reception, the reception process can be reliably prevented from executing multiple times in one day if the reception interval time is set to 24 hours, for example. As a result, the number of times the reception process executes can be minimized, the reception process can be executed efficiently, and an increase in power consumption and decrease in battery life can be prevented.

In an electronic device according to another aspect of the invention, the reception control unit operates the reception unit and starts the reception operation when a user starts reception by a manual operation.

Because the evaluation unit selects the reception mode based on power generation by the solar panel even when the reception operation is started manually, the reception process can be executed efficiently, and an increase in power consumption and decrease in battery life can be prevented.

Another aspect of the invention is a satellite signal reception method for an electronic device having a reception unit that captures positioning information satellites and receives satellite signals transmitted from the captured positioning information satellites, a reception control unit that controls the reception unit, and a solar panel, the satellite signal reception method including: an evaluation step of evaluating the reception environment based on power generation by the solar panel; a mode selection step of selecting, based on the result from the evaluation unit, a time information reception mode for receiving the satellite signals and acquiring time information, or a position and time information reception mode for receiving the satellite signals and acquiring positioning information and time information; and a reception control step of controlling operation of the reception unit in the reception mode selected in the mode selection step.

Another aspect of the invention is a satellite signal reception method for an electronic device having a reception unit that captures positioning information satellites and receives satellite signals transmitted from the captured positioning information satellites, a reception control unit that controls the reception unit, and a solar panel, the satellite signal reception method including an evaluation step of evaluating the reception environment based on power generation by the solar panel; a time-out time setting step of setting a time-out time based on the result from the evaluation step; and a reception control step of stopping the reception unit and ending reception if the time-out time set in the time-out time setting step is reached without reception succeeding after the reception unit is operated and reception started.

These aspects of the invention can execute an efficient reception process according to the reception environment, and can prevent increased power consumption and a shortened battery life.

DESCRIPTION OF THE PREFERRED EMBODIMENTS

A preferred embodiment of the present invention is described below with reference to the accompanying figures.

The embodiment described below is a specific preferred embodiment of the present invention and certain technically preferred limitations are therefore also described, but the scope of the present invention is not limited to these embodiments or limitations unless specifically stated below.

Embodiment 1

Figure 1:
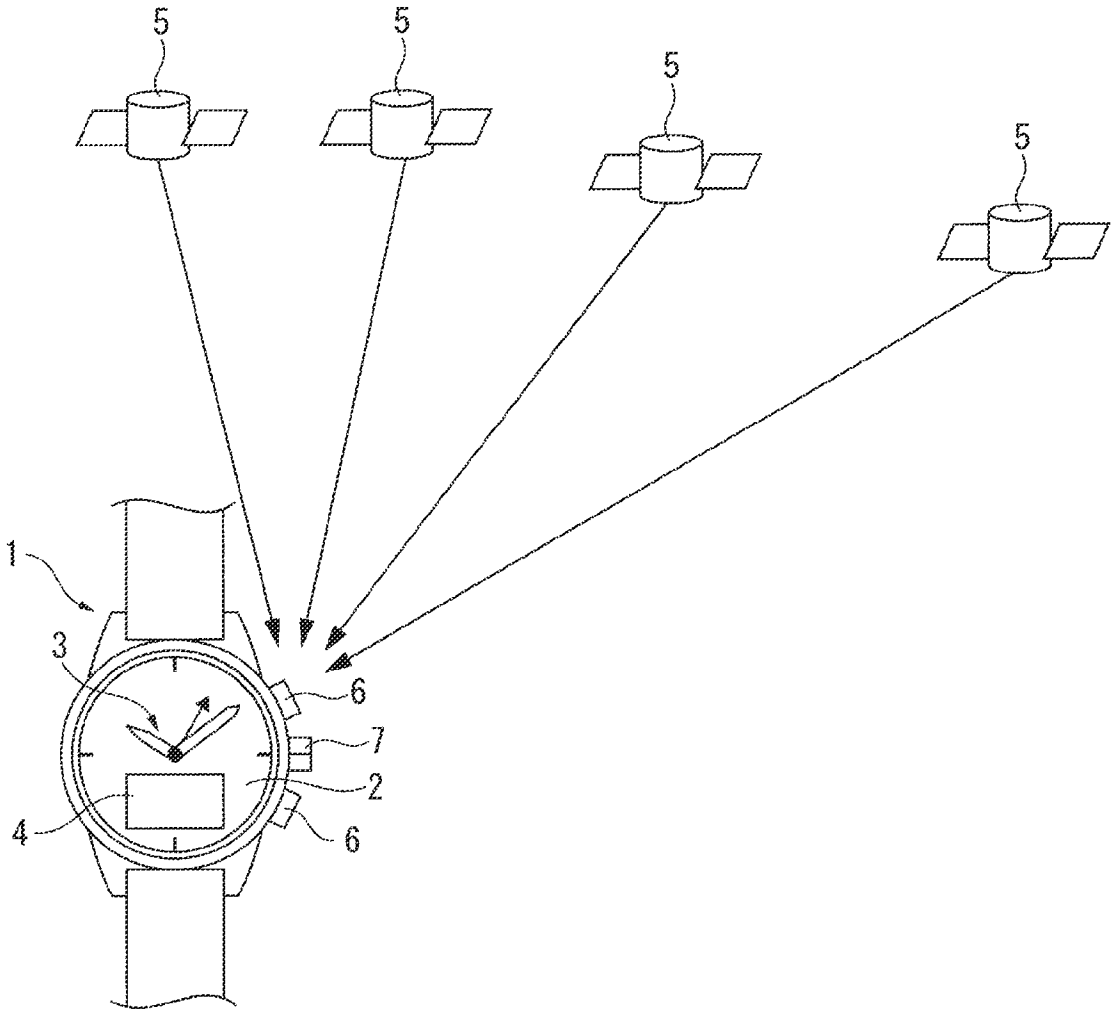
FIG. 1 schematically describes a GPS wristwatch according to a preferred embodiment of the invention.
Figure 2:
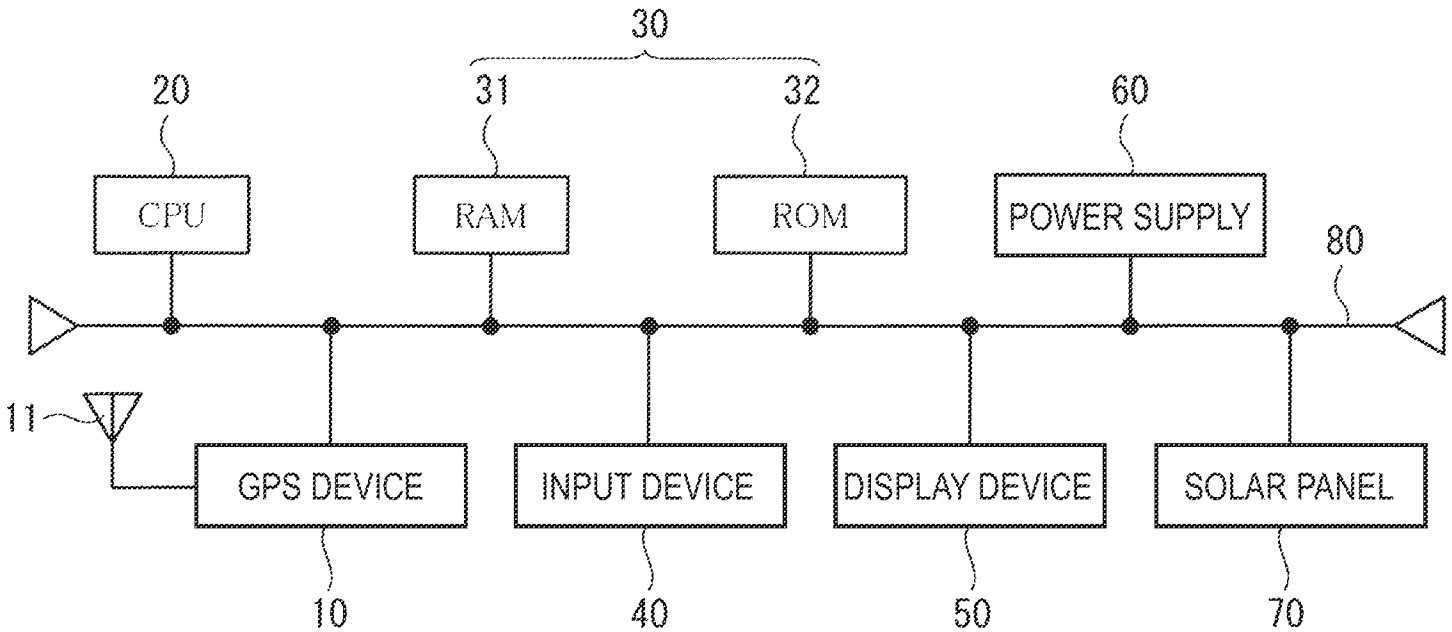
FIG. 2 is a block diagram showing the circuit configuration of the GPS wristwatch.

FIG. 1 is a schematic diagram showing a wristwatch with a GPS satellite signal reception device 1 (referred to below as a GPS wristwatch 1) as an example of an electronic timepiece according to the present invention. FIG. 2 shows the main hardware configuration of the GPS wristwatch 1.

As shown in FIG. 1, the GPS wristwatch 1 has a time display unit including a dial 2 and hands 3. A window is formed in a part of the dial 2, and a display 4 such as an LCD panel is located in this window.

The hands 3 include a second hand, minute hand, and hour hand, and are driven through a wheel train by means of a stepping motor.

The display 4 is typically a LCD unit, for example, and is used for displaying messages in addition to positioning information such as the longitude and latitude or a city name.

The GPS wristwatch 1 receives satellite signals from a plurality of GPS satellites 5 orbiting the Earth on fixed orbits in space and acquires satellite time information to adjust the internally kept time and positioning information, that is, the current location, on the display 4.

The GPS satellite 5 is an example of a positioning information satellite in the invention, and a plurality of GPS satellites 5 are orbiting the Earth in space. At present there are approximately 30 GPS satellites 5 in orbit.

The GPS wristwatch 1 has a crown 7 and buttons 6, that is, external operating members.

Circuit Design of the GPS Wristwatch

As shown in FIG. 2, the GPS wristwatch 1 has a GPS device 10 (GPS module), a control device 20 (CPU), a storage device 30 (storage unit), an input device 40, a display device 50 (display unit), a power supply 60, and a solar panel. The storage device 30 includes RAM 31 and ROM 32. Data is communicated between these different devices over a data bus 80, for example.

The display device 50 includes hands 3 and a display 4 for displaying the time and positioning information.

The power supply 60 is a storage battery that can store power produced by the solar panel 70.

GPS Device Configuration

The GPS device 10 has a GPS antenna 11 and acquires time information and positioning information by processing satellite signals received through the GPS antenna 11.

The GPS antenna 11 is a patch antenna for receiving satellite signals from a plurality of GPS satellites 5 orbiting the Earth on fixed orbits in space. The GPS antenna 11 is located on the back side of the dial 12, and receives RF signals through the crystal and the dial 2 of the GPS wristwatch 1.

The dial 2 and crystal are therefore made from materials that pass RF signals such as the satellite signals transmitted from the GPS satellites 5. The dial 2, for example, is plastic.

Although not shown in the figures, the GPS device 10 includes an RF (radio frequency) unit that receives and converts satellite signals transmitted from the GPS satellites 5 to digital signals, a baseband unit that correlates the reception signal and synchronizes with the satellite, and a data acquisition unit that acquires the time information and positioning information from the navigation message (satellite signal) demodulated by the baseband unit, similarly to a common GPS device.

The RF unit includes bandpass filter, a PLL circuit, an IF filter, a VCO (voltage controlled oscillator), an A/D converter, a mixer, a low noise amplifier, and an IF amplifier.

The satellite signal extracted by the bandpass filter is amplified by the low noise amplifier, mixed by the mixer with the signal from the VCO, and down-converted to an IF (intermediate frequency) signal. The IF signal mixed by the mixer passes the IF amplifier and IF filter, and is converted to a digital signal by the A/D converter.

The baseband unit includes a local code generator and a correlation unit. The local code generator generates a local C/A code (also referred to as a "local code" herein) that is identical to the C/A code used for transmission by the GPS satellite 5. The correlation unit calculates the correlation between this local code and the reception signal output from the RF unit.

If the correlation calculated by the correlation unit is greater than or equal to a predetermined threshold value, the generated local code and the C/A code used in the received satellite signal match, and the satellite signal can be captured (that is, the receiver can synchronize with the satellite signal). The navigation message can thus be demodulated by applying this correlation process to the received satellite signal using the local code.

The data acquisition unit acquires the time information and positioning information from the navigation message demodulated by the baseband unit. More specifically, the navigation message transmitted from the GPS satellites 5 contains subframe data such as a preamble and the TOW (Time of Week, also called the Z count) carried in a HOW (handover word). The subframe data is divided into five subframes, subframe 1 to subframe 5, and the subframe data includes the week number, satellite correction data including the satellite health, the ephemeris (detailed orbital information for the particular GPS satellite 5), and the almanac (approximate orbit information for all GPS satellites 5 in the constellation).

The data acquisition unit extracts a specific part of the data from the received navigation message, and acquires the time information and positioning information. The GPS device 10 thus renders a reception unit in this embodiment of the invention.

A program, for example, that is run by the control device 20 is stored in ROM 32 in the storage device 30.

Time information, positioning information and time difference data acquired by satellite signal reception, and the power output of the solar panel 70 (such as the output voltage), are stored in RAM 31 in the storage device 30.

Figure 3:
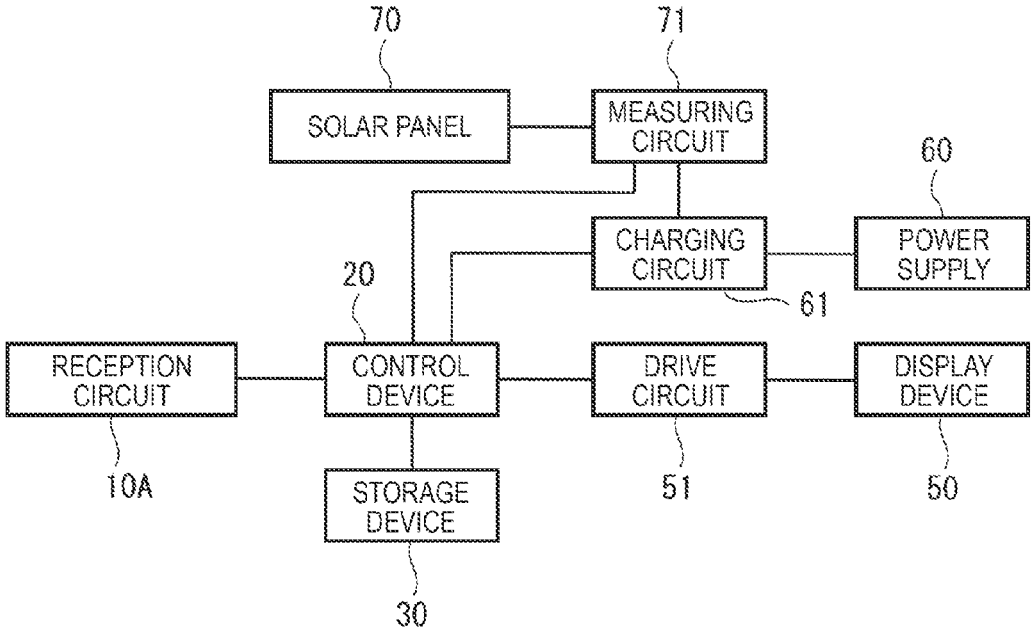
FIG. 3 is a block diagram showing the system configuration of the GPS wristwatch.
Figure 4:
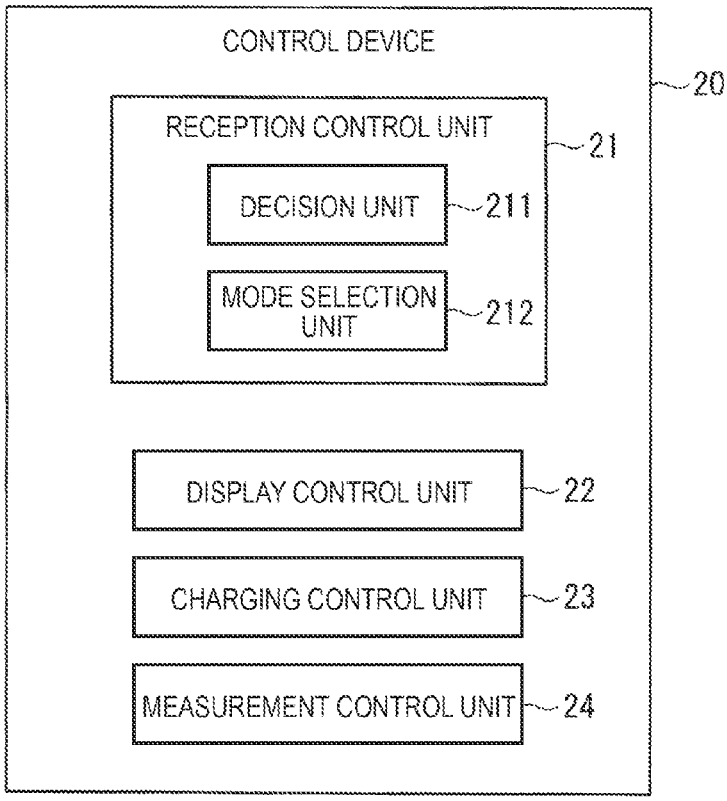
FIG. 4 is a block diagram showing the configuration of the control device.

FIG. 3 is a circuit block diagram of the GPS wristwatch 1 according to this embodiment of the invention.

The control device 20 (control circuit) controls the reception circuit 10A of the GPS device 10 and controls the display device 50 through a drive circuit 51. The control device 20 also controls a charging circuit 61 and controls the process of charging the power supply 60.

The GPS wristwatch 1 also has a measuring circuit 71 that measures the power generation (voltage output) of the solar panel 70, and the control device 20 can control the operation of the measuring circuit 71 and detect the measurement from the measuring circuit 71.

The control device 20 (control circuit, CPU) thus controls operation by running a program stored in ROM 32. As a result, the control device 20 has a reception control unit 21, a display control unit 22, a charging control unit 23, and a measurement control unit 24.

The display control unit 22 controls the content displayed on the display device 50 through the drive circuit 51. For example, the display control unit 22 executes a process of moving the hands 3 of the display device 50 based on the acquired information when time information is acquired by the reception process. When positioning information is acquired, the display control unit 22 executes a process for displaying positioning information on the display 4.

The charging control unit 23 determines the charge state of the power supply 60 by means of the charging circuit 61, and controls the charging process to prevent overcharging.

The measurement control unit 24 operates the measuring circuit 71 to measure the power generation (output voltage) of the solar panel 70, and executes a process to acquire and store the measurement from the measuring circuit 71 in RAM 31 in the storage device 30.

The reception control unit 21 includes a decision unit 211 and a mode selection unit 212.

The decision unit 211 evaluates the reception environment based on the power generated by the solar panel 70 as measured by the measurement control unit 24. The specific process executed by the decision unit 211 is further described below.

The mode selection unit 212 selects the time information reception mode or a position and time information reception mode based on the result from the decision unit 211.

The reception control unit 21 controls the reception circuit 10A based on the reception mode selected by the mode selection unit 212 and executes the reception process.

Reception Process

Figure 5:
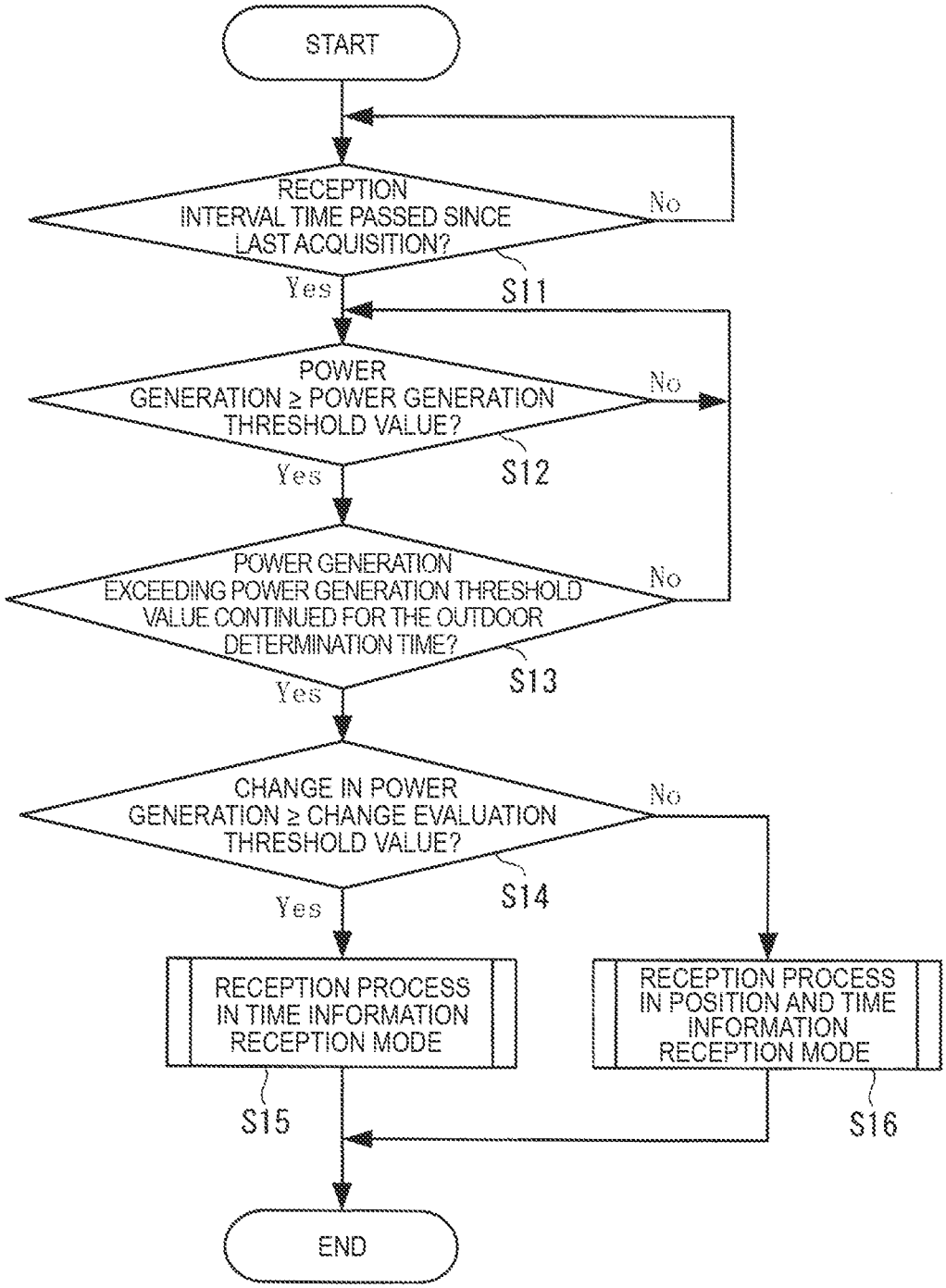
FIG. 5 is a flow chart of the reception process of the control device.

Reception control by the reception control unit 21 is described next with reference to the flow chart in FIG. 5. The process shown in FIG. 5 is the process executed when reception is triggered automatically.

The decision unit 211 of the reception control unit 21 first decides if a set reception interval time has passed since the last time information was received (S11). This set reception interval time may be set based on the reception interval required by the GPS wristwatch 1, and in this embodiment of the invention is set to 24 hours.

The reception process is controlled to not start until step S11 returns Yes, that is, until the time passed since the last time the information was received at least equals this set reception interval time.

If Yes is returned in S11, the decision unit 211 operates the measuring circuit 71 by means of the measurement control unit 24, and determines if the power output of the solar panel 70 is greater than or equal to a power generation threshold value (S12). The measuring circuit 71 more specifically measures the output voltage of the solar panel 70.

Figure 6:
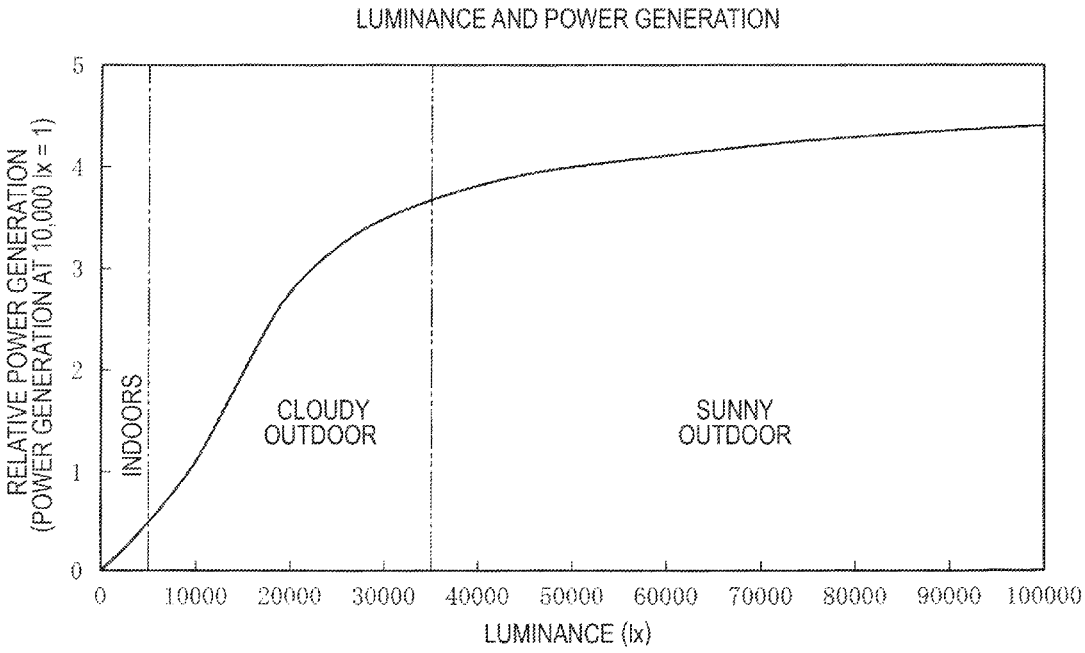
FIG. 6 is a graph showing an example of the relationship between luminance and power generation.

This power generation threshold value is set based on the relationship between the luminance of light incident to the solar panel 70 and the power output of the solar panel 70. FIG. 6 is a graph showing the relationship between relative power output and luminance where power generation at 10,000 lx (lux) is 1. As shown in FIG. 6, power generation by the solar panel 70 is greatest during the day on a sunny day, and on a cloudy day power generation drops compared with power generation on a sunny day. In addition, power generation is even lower when indoors compared with outdoor on a cloudy day.

Because power generation is better when outdoor than indoors regardless of whether the weather is sunny or cloudy, the power generation threshold value for evaluating the power generation environment is set to a value that enables differentiating power generation in an indoor environment (less than approximately 5000 lx) from an outdoor environment (greater than approximately 5000 lx). In the example shown in FIG. 6, if the power generation threshold value is set to approximately 0.5 on the relative power generation scale, whether the electronic device is indoor or outdoor can be determined.

The decision unit 211 then determines if power generation greater than or equal to the power generation threshold value has continued for at least an outdoor determination time (S13). This outdoor determination time may be set to several seconds (such as 3 seconds). When indoors, for example, light passing through a window may momentarily illuminate the solar panel 70, causing the power generation measured by the measuring circuit 71 to exceed the power generation threshold value, and resulting in a false determination of being outdoor.

However, if power generation exceeding the power generation threshold value continues for the outdoor determination time, the GPS wristwatch 1 can be correctly determined to be outdoor.

If No is returned in any step S12 or step S13, the decision unit 211 repeats step S12.

If Yes is returned in S13, the decision unit 211 determines if the change in power generation during a specified change monitoring time is greater than or equal to a change evaluation threshold value (S14). This specified change monitoring time is set to approximately 10-20 seconds, for example.

Power generation by the solar panel 70, that is, the output voltage, changes according to the orientation of the solar panel 70 to the sun. In the case of a GPS wristwatch 1, for example, there is substantially no change in power generation if the user holds the GPS wristwatch 1 still with the solar panel 70 facing the sun. If the GPS wristwatch 1 is thus held still while facing the sun, the reception environment is good because the orientation and position relative to the GPS satellite 5 are constant.

However, if the user is wearing the GPS wristwatch 1 on his wrist while walking, the orientation of the GPS wristwatch 1 will change constantly as a result of the wrist swinging, and power generation will therefore also change. Power generation may also change when the user moves into the shadow of a building, for example. The reception environment in such situations can be considered poor because the position and orientation of the GPS wristwatch 1 to the GPS satellite 5 is constantly changing and there are times when there is an obstruction such as a building between the GPS satellite 5 and the GPS wristwatch 1.

Figure 7:
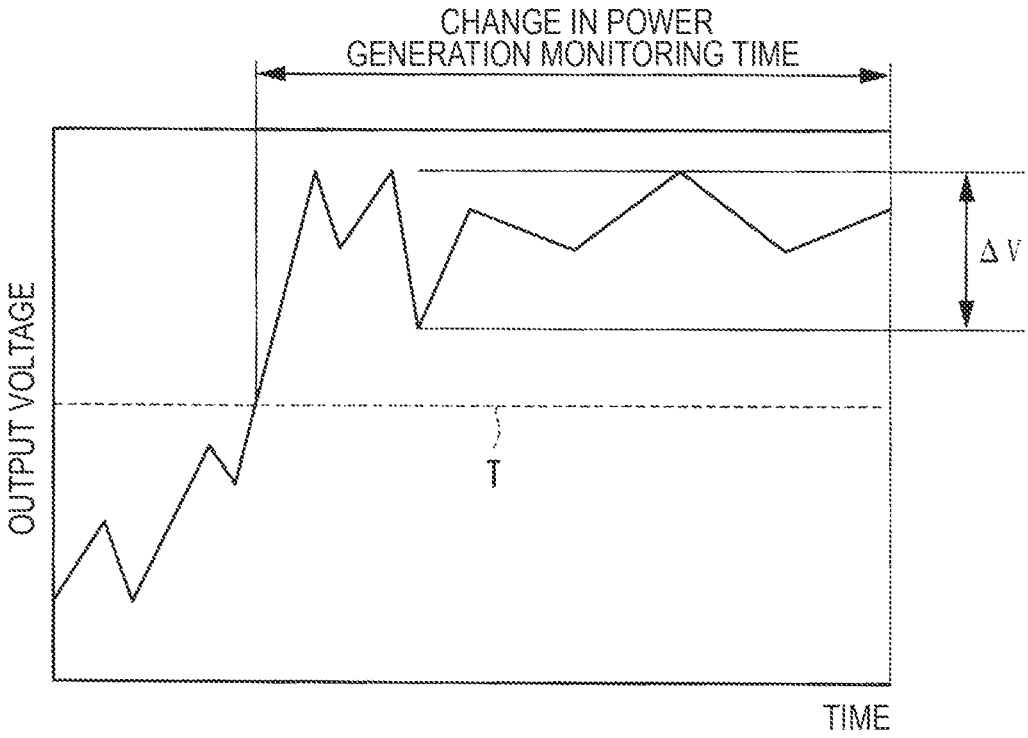
FIG. 7 is a graph showing an example of the change in voltage output over time.

Therefore, as shown in FIG. 7, the decision unit 211 monitors the change in power output for a predetermined change monitoring time (such as 10 seconds) from when power generation (output voltage) exceeds a power generation threshold T, and detects the change in power generation $\Delta V$, which is the difference between the maximum and minimum output voltage during the change monitoring time. If this change in power generation $\Delta V$ is less than the preset change evaluation threshold value, the decision unit 211 determines that the reception environment is good. If the change in power generation $\Delta V$ is greater than or equal to the preset change evaluation threshold value, the decision unit 211 determines that the reception environment is not good.

Note that the change evaluation threshold value may be set based on actual test data, for example. For example, the change when walking while wearing the GPS wristwatch 1 and when moving in and out of building shadows may be measured, and the change evaluation threshold value could be set to half of the measured maximum change.

If Yes is returned in S14, the mode selection unit 212 selects the time information reception mode and executes the reception process because the reception environment is not good (S15).

However, if No is returned in S14, the mode selection unit 212 selects the position and time information reception mode and executes the reception process because the reception environment is good (S16).

Time Information Reception Mode

The process executed in the time information reception mode (S15) is described next.

When processing starts in the time information reception mode (S15), the reception control unit 21 executes a single satellite search process to search for a GPS satellite 5 and capture one GPS satellite 5 (S21).

The reception control unit 21 then determines if a satellite was captured (S22). If the reception control unit 21 determines in S22 that a satellite was not captured, it determines if a specified time has passed since the search started, that is, determines if reception timed out (S23). This time-out time for the search process is set to approximately 3 seconds, for example.

If operation has not timed out in S23, control returns to the satellite capture determination process in step S22.

If operation has timed out in S23, the reception control unit 21 stops the GPS reception process (S24). The display control unit 22 also displays an indication that reception failed, and displays the current internal time (S25).

If a satellite was captured in S22, the reception control unit 21 determines if the time information was acquired (S26).

If the time information was not acquired in S26, the reception control unit 21 determines if a specific time has passed since the satellite was captured, that is, determines if the decoding operation timed out (S27). This decoding time-out time is set to approximately 1 minute, for example.

If the decoding operation has not timed out in S27, control returns to the time information acquisition decision process in S26. If the decoding operation has timed out in S27, the reception control unit 21 stops the GPS reception process (S24). The display control unit 22 also displays an indication that reception failed, and displays the current internal time (S25).

If Yes is returned in S26, the reception control unit 21 stops the GPS reception process (S28). The display control unit 22 also displays an indication that reception succeeded, and displays the acquired time information (S29).

Position and Time Information Reception Mode

Processing the position and time information reception mode (S16) is described next with reference to FIG. 9.

Figure 8:
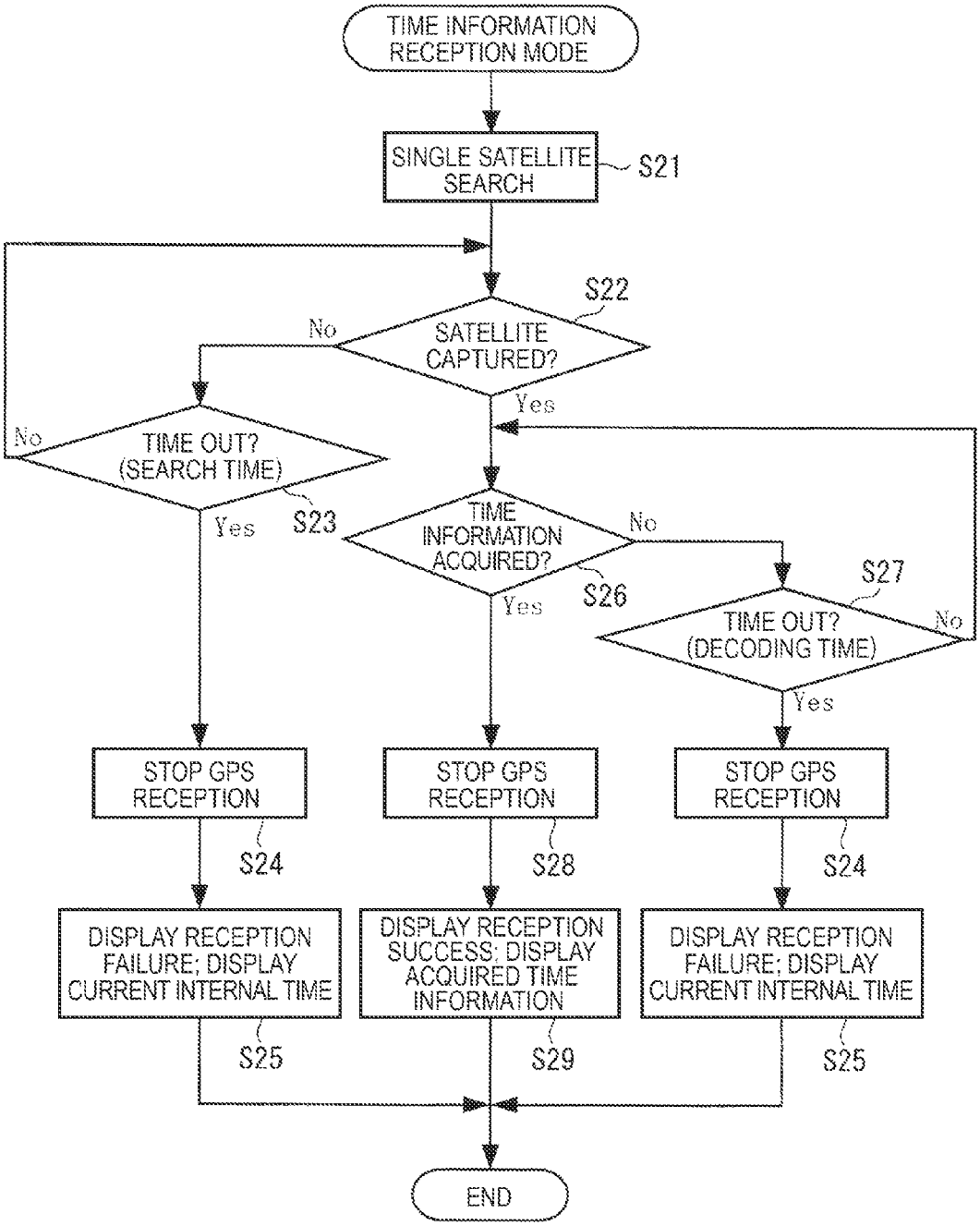
FIG. 8 is a flow chart of the process executed in the time information reception mode.
Figure 9:
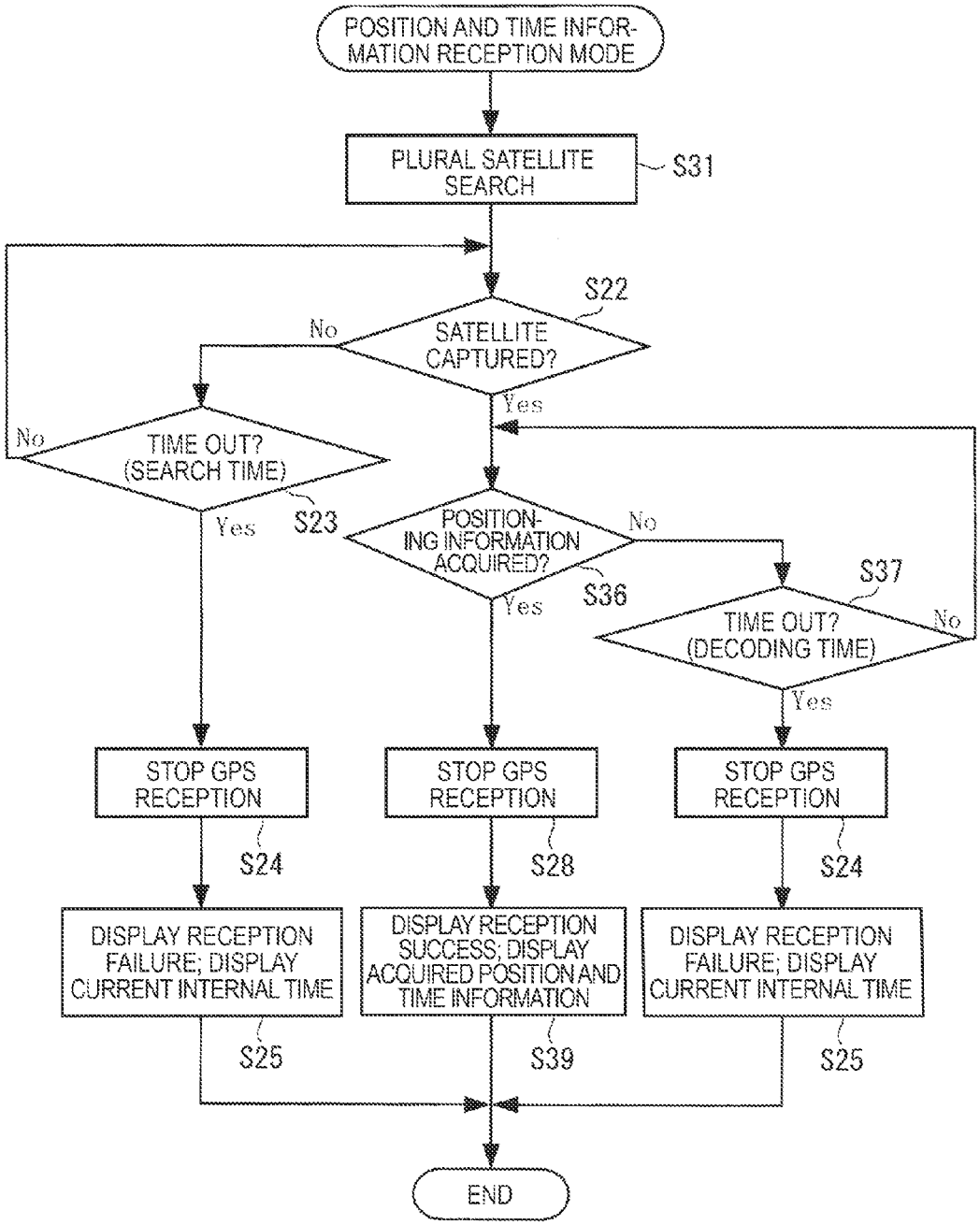
FIG. 9 is a flow chart of the process executed in the position and time information reception mode.

As shown in FIG. 9, the position and time information reception mode (S16) executes a search process for plural satellites (S31) instead of the single satellite search process (S21) executed in the time information reception mode (S15) shown in FIG. 8, executes a positioning information acquisition process (S36) instead of the time information acquisition process (S26), and executes an acquired position and time information display process (S39) instead of the acquired time information display process (S29).

In the position and time information reception mode, the ephemeris parameter containing detailed current orbit information must be acquired for at least three GPS satellite 5, and preferably for four. As a result, this plural satellite search process (S31) determines if four GPS satellites 5 have been acquired.

Based on the satellite signals sent from the captured GPS satellites 5, the positioning information acquisition process (S36) acquires the ephemeris parameter that is required to the calculate the position, and acquires the positioning information.

Capturing the ephemeris parameter for four satellites requires approximately one to two minutes. The time-out period of the decoding operation in S37 is therefore set to 3 minutes, for example, and operation times out if the positioning information cannot be acquired after 3 minutes. The time-out time (1 minute, for example) of the decoding period in S27 in the time information reception mode is therefore set to a shorter time than the time-out time (3 minutes, for example) of the decoding period in S37 in the position and time information reception mode.

Note that the operations executed in the other steps in the position and time information reception mode are the same as in the time information reception mode shown in FIG. 8, and detailed description thereof is thus omitted.

The effect of this embodiment of the invention is described next.

Because the decision unit 211 evaluates the reception environment based on power generation by the solar panel 70, the mode selection unit 212 can select either the time information reception mode or the position and time information reception mode as the reception mode that is appropriate to the reception environment. Because the position and time information reception mode can therefore be selected only when the reception environment is good, satellite signals can be received efficiently, power consumption can be reduced, and the battery life can be extended.

Furthermore, because the decision unit 211 determines the reception environment with consideration for the change in power generation as a result of the operation in step 14, the reception mode can be selected with consideration for the condition of the GPS wristwatch 1 in addition to whether the GPS wristwatch 1 is outdoor, and the reception mode can therefore be selected more appropriately.

Furthermore, because the decision unit 211 automatically starts reception if power generation exceeding the power generation threshold value continues for the outdoor determination time as a result of step S13, the reception process can be executed automatically when the GPS satellite 5 moves outdoor. As a result, if the reception process is configured to execute regularly at a preset time, the reception process may start while the GPS wristwatch 1 is indoors, but because this embodiment of the invention executes the reception process only when the GPS wristwatch 1 has moved outdoor, the reception process can be executed in a better reception environment than when indoor.

Furthermore, because step S12 in this embodiment of the invention prevents further processes from executing if power generation does not surpass the power generation threshold value, that is, if the GPS wristwatch 1 does not move outdoor, the reception process will not execute needlessly when the GPS wristwatch 1 is left indoors, power consumption can therefore be reduced and the battery life can be extended.

In addition, because the remaining steps in the automatic reception process are not executed as a result of step S11 in this embodiment of the invention if the set reception interval time (such as 24 hours) has not passed since the last time the information acquisition process executed, execution of the reception process can be minimized. As a result, power consumption can be further reduced and the battery life can be extended.

Yet further, because the time-out time in the time information reception mode (S27) is set shorter than the time-out time in the position and time information reception mode (S37), the reception control unit 21 can quickly abort the reception process if the time information cannot be received in the time information reception mode, which is executed when the reception environment is potentially poor. Needlessly continuing the reception process can therefore be prevented and current consumption can be reduced.

Furthermore, because the decision unit 211 evaluates the reception environment using power produced by the solar panel 70, which can also be used as a power supply, the parts count is smaller than a configuration that uses dedicated parts to evaluate the reception environment, and the GPS wristwatch 1 can therefore be made smaller and the cost reduced.

Embodiment 2

Figure 10:
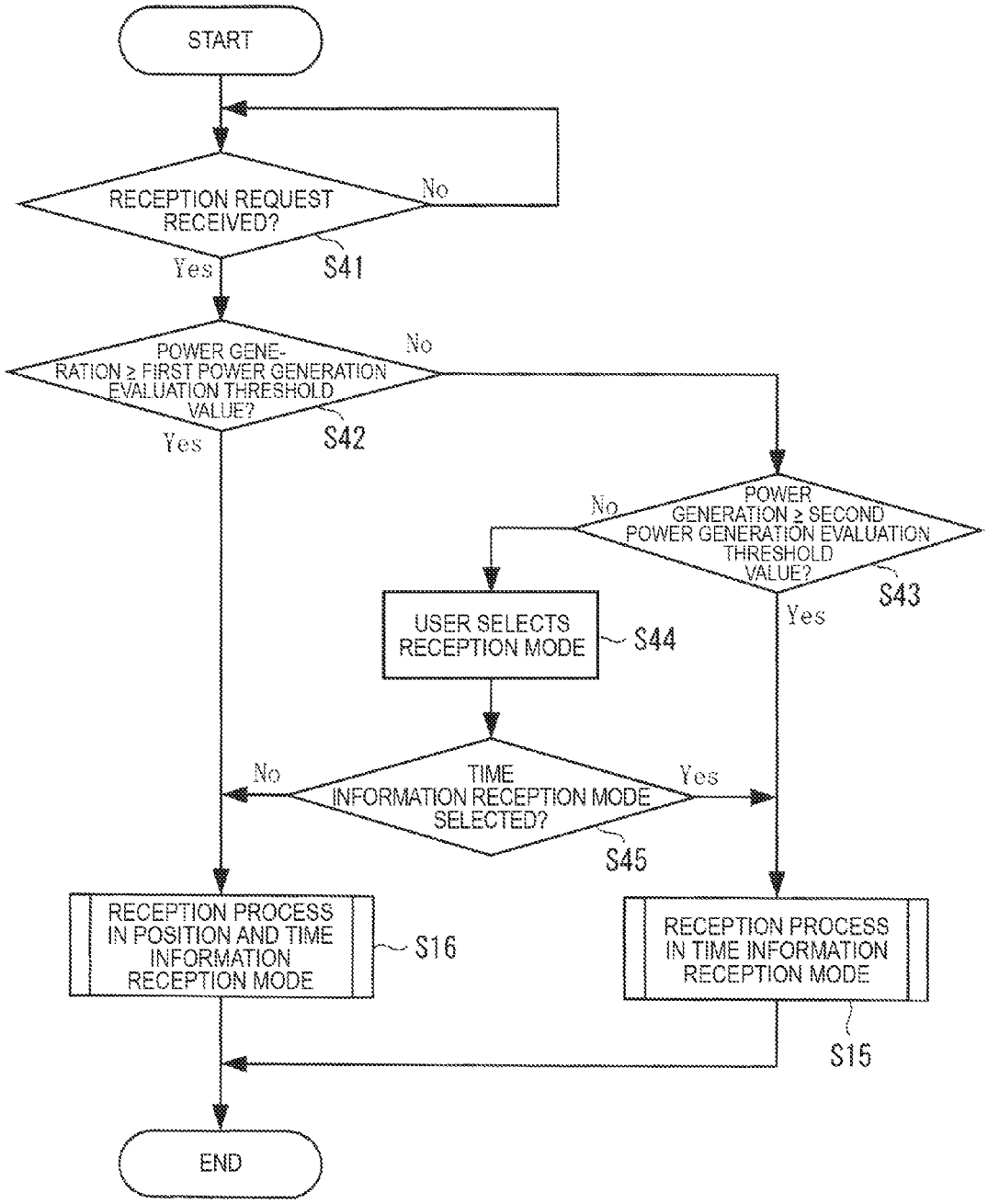
FIG. 10 is a flow chart of the reception process in a second embodiment of the invention.

A second embodiment of the invention is described next with reference to the flow chart in FIG. 10.

Note that the circuit configuration of the GPS wristwatch 1 according to the second embodiment of the invention is the same as in the first embodiment, and further description thereof is thus omitted.

The second embodiment of the invention first checks if a reception request was asserted (S41). A reception request is a signal requesting the reception control unit 21 to start the reception process, and is output when the user manually starts the reception process or when a predetermined reception time arrives.

If a reception request is detected, the decision unit 211 determines if power generation is greater than or equal to a first power generation evaluation threshold value (S42). This first power generation evaluation threshold value may be a threshold value for determining whether the current location is outdoor during the day or is indoor, and can therefore be set to the same value as the power generation threshold value in the first embodiment above.

If Yes is returned in S42, the GPS wristwatch 1 is determined to be outdoor and the reception environment good. The mode selection unit 212 therefore selects the position and time information reception mode as in the first embodiment and executes the reception process (S16).

However, if No is returned in S42, the decision unit 211 determines if power generation is greater than or equal to a second power generation evaluation threshold value (S43).

If No is returned in S42, power generation is low because the GPS wristwatch 1 is located indoors, is located indoors with the lights off, or is outdoor after dark, for example. This second power generation evaluation threshold value is therefore set to a lower value (such as 0 on the relative power generation scale) than the power generation resulting from indoor lighting.

Therefore, if S43 returns Yes, the GPS wristwatch 1 is determined to be indoors, and the mode selection unit 212 selects and executes the reception process in the time information reception mode (S15) as described in the first embodiment.

However, if S43 returns No, the decision unit 211 cannot determine if the GPS wristwatch 1 is indoors with the lights off or outdoor at night. As a result, the mode selection unit 212 sets the GPS wristwatch 1 so that the user can select the reception mode (S44).

The mode selection unit 212 then determines if the user selected the time information reception mode (S45).

If the user selected the time information reception mode, the reception control unit 21 executes the reception process in that mode (S15).

If the user selected the position and time information reception mode, the reception control unit 21 executes the reception process in that mode (S16).

This second embodiment of the invention achieves the same effect as the first embodiment.

In addition, because the user must select the reception mode when power generation by the solar panel 70 is low, such as when reception is manually forced while outdoor at night or indoors with the lights off, signals can be received efficiently even at night if the user selects the position and time information reception mode when the GPS wristwatch 1 is located in a good outdoor reception environment. On the other hand, if the GPS wristwatch 1 is inside a room with the lights turned off, the reception process can be efficiently executed if the user selects the time information reception mode considering the reception environment.

Embodiment 3

A third embodiment of the invention is described next with reference to the flow chart in FIG. 11.

Figure 11:
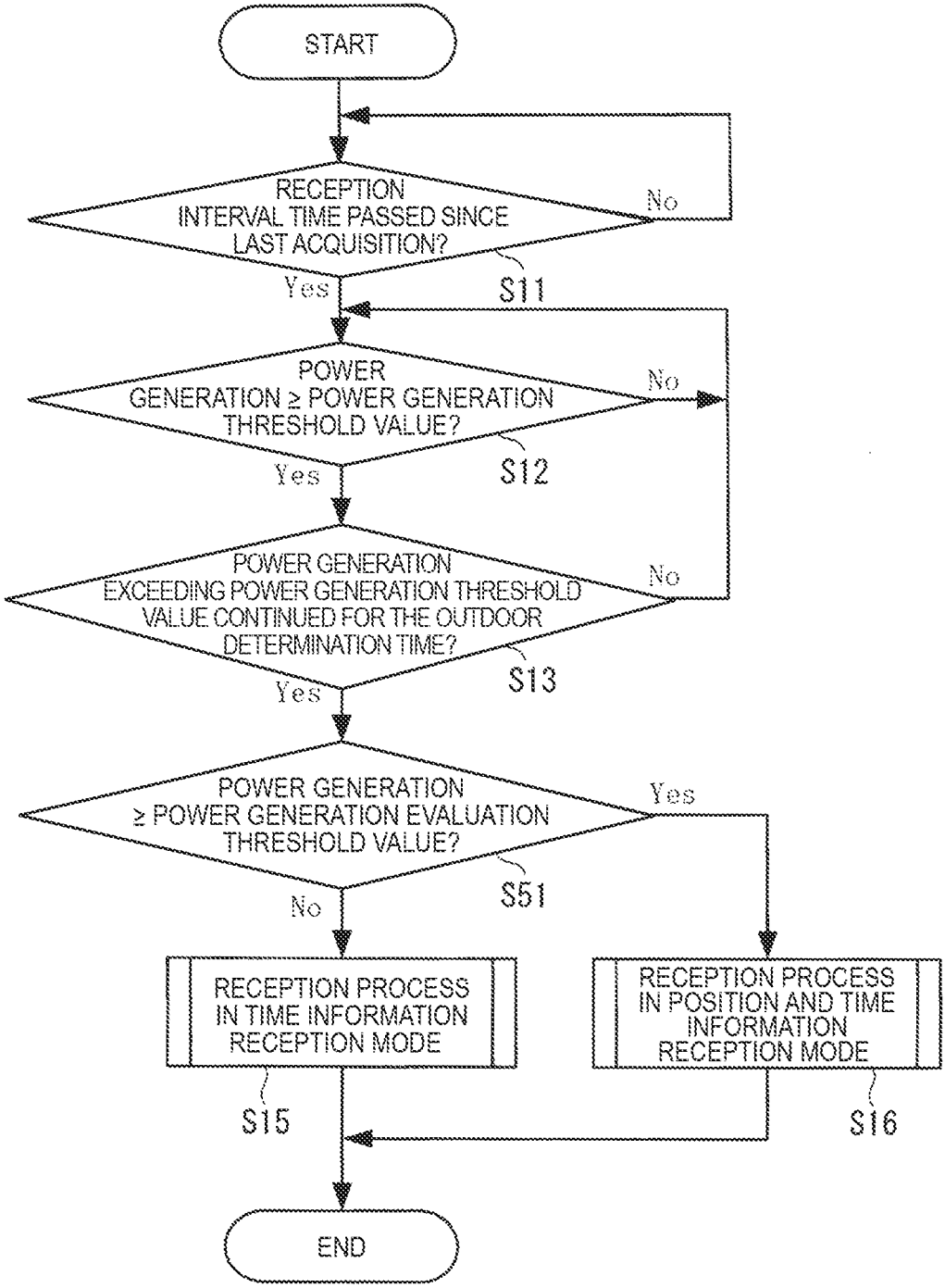
FIG. 11 is a flow chart of the reception process in a third embodiment of the invention.

This third embodiment differs from the foregoing first embodiment only in that the reception mode is selected based on whether or not power generation is greater than or equal to a power generation evaluation threshold value as shown in step S51 in FIG. 11. Other aspects of the configuration and process according to this embodiment of the invention are the same as the first embodiment, and further description thereof is omitted.

More specifically, if as described in the first embodiment the set reception interval time has passed since the last time information was received (S11 returns Yes), the power output is greater than or equal to a power generation threshold value (S12 returns Yes), and power generation greater than or equal to the power generation threshold value has continued for at least an outdoor determination time (S13 returns Yes), whether or not the power generation exceeds a power generation evaluation threshold value is determined (S51) in this third embodiment.

This power generation evaluation threshold value may be the same value as the power generation threshold value used in step S12, or it may be a higher value.

If the power generation evaluation threshold value is greater than the power generation threshold value, the power generation evaluation threshold value is set so that whether the GPS wristwatch 1 is located in direct sunlight with a clear view to the sky, or is located in the shadow of a building, can be determined. In this configuration, the reception process is executed in the time information reception mode (S15) if power generation is lower than the power generation evaluation threshold value because the GPS wristwatch 1 is in the shadow of a building, for example, but if power generation is greater than or equal to the power generation evaluation threshold value, that is, the GPS wristwatch 1 is outdoor with a clear view to the sky, the reception process is executed in the position and time information reception mode (S16).

Note, however, that if the threshold values are the same, whether the GPS wristwatch 1 is indoor or outdoor is checked again in S51. If S51 then returns No, the reception process is executed in the time information reception mode (S15), that is, the mode in which indoor reception may be possible, but if the GPS wristwatch 1 is outdoor and S51 returns Yes, the reception process is executed in the position and time information reception mode (S16).

This third embodiment of the invention has the same effect as the first embodiment.

In addition, because the reception mode is selected by comparing power generation with a power generation evaluation threshold value (S51), the reception environment can be evaluated and the reception mode can be selected more quickly than when the change in power generation during a change monitoring time is evaluated as in the first embodiment.

Embodiment 4

Figure 12:
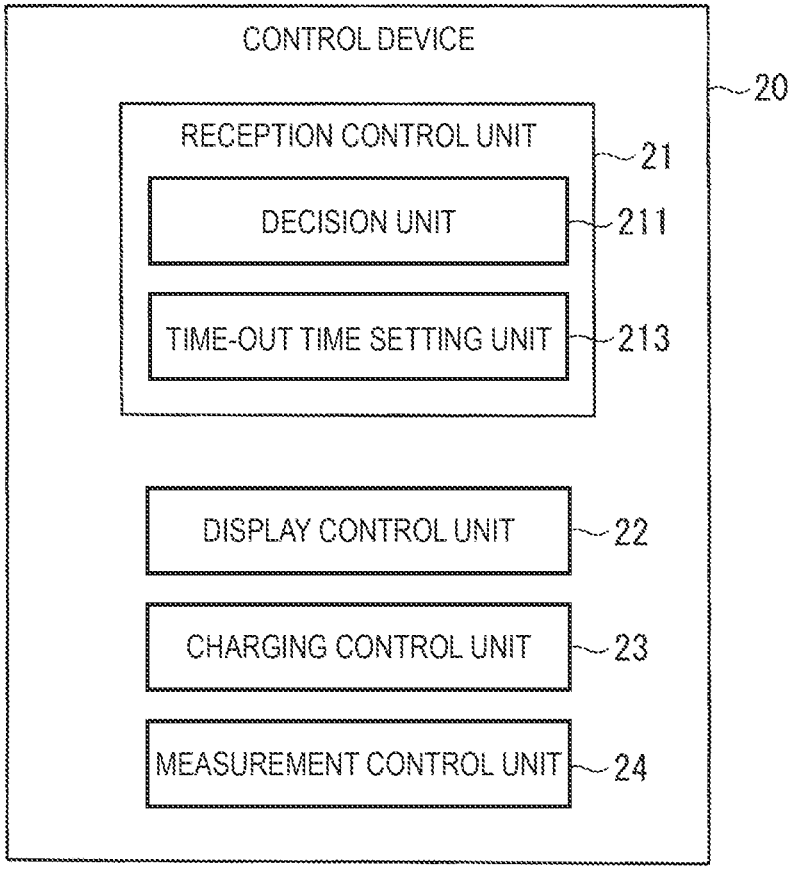
FIG. 12 is a block diagram showing the configuration of the control device in a fourth embodiment of the invention.
Figure 13:
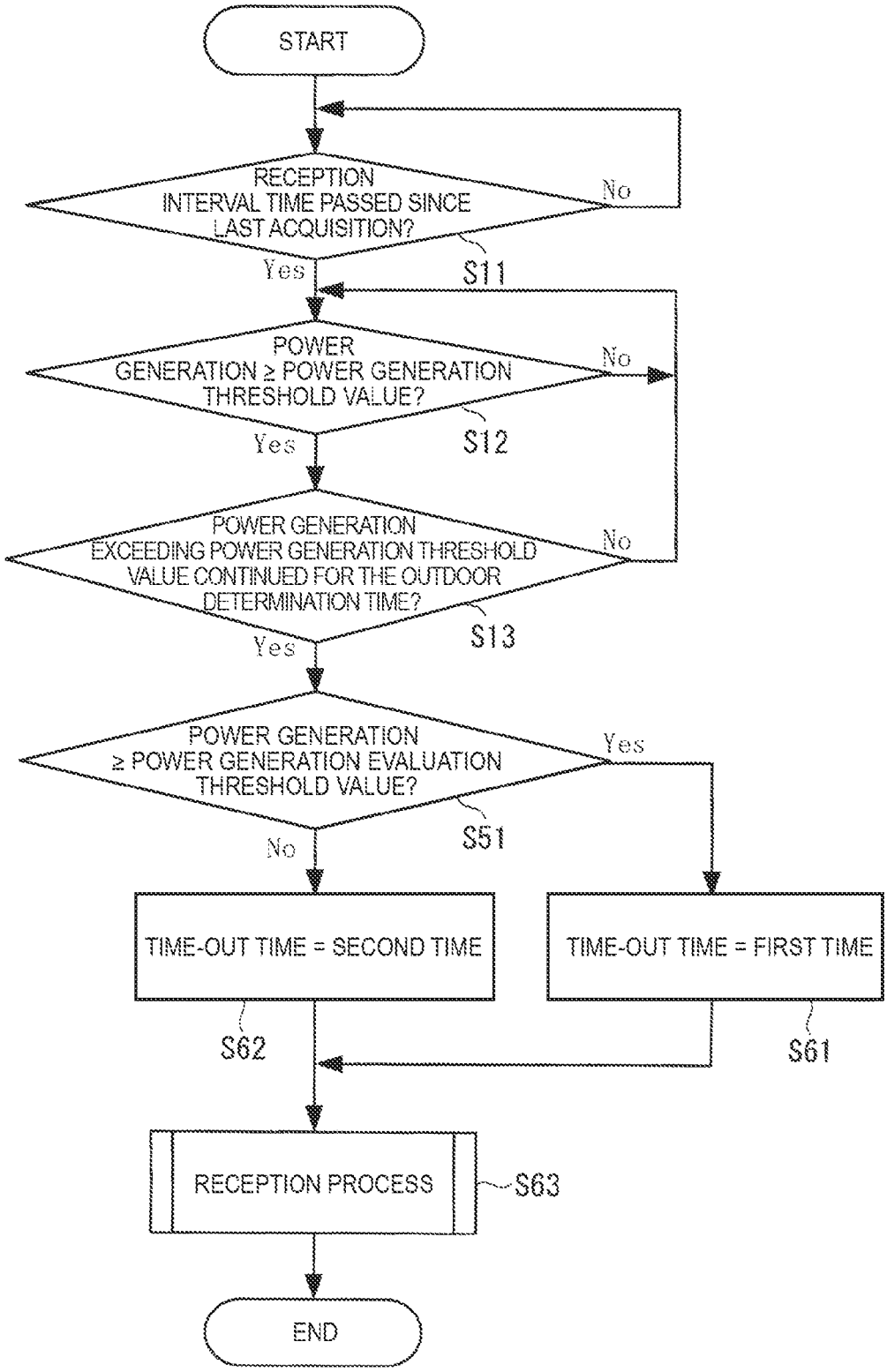
FIG. 13 is a flow chart of the reception process in the fourth embodiment of the invention.

A fourth embodiment of the invention is described next with reference to the block diagram in FIG. 12 and the flow chart in FIG. 13.

Each of the foregoing embodiments has a mode selection unit 212 that selects the reception mode based on the power generation or change in power generation. As shown in FIG. 12, this fourth embodiment of the invention differs by having a time-out time setting unit 213 instead of the mode selection unit 212.

More specifically, as described in the third embodiment, the decision unit 211 determines whether or not power generation is greater than or equal to the power generation evaluation threshold value through steps S11, S12, S13, and S51. Also note that as in the third embodiment the power generation evaluation threshold value may be the same as or different from the power generation threshold value used in step S12.

If in S51 power generation is determined to be greater than or equal to the power generation evaluation threshold value, the time-out time setting unit 213 sets the time-out time to a first time (such as 3 minutes) (S61).

However, if S51 returns No, the time-out time setting unit 213 sets the time-out time to a second time (such as 1 minute) that is shorter than the first time (S62).

The reception control unit 21 then executes the reception process (S63). A satellite search is conducted and processes acquiring time information and positioning information from the captured GPS satellites 5 are executed in the reception process as described in the foregoing embodiments, but the reception process ends if the time-out time set by the time-out time setting unit 213 is reached after reception starts.

Therefore, if the time-out time is set to the first time (3 minutes), there is a good possibility that positioning information and time information can be acquired from three or more GPS satellites 5 within the first time because the GPS wristwatch 1 is outdoor and the likelihood that the reception environment is good is high.

If the reception control unit 21 successfully acquires positioning information and time information from three or more GPS satellites 5, the acquired position and time information display process is executed as in step S39 in the first embodiment.

If positioning information and time information are not acquired from three or more GPS satellites 5, but time information is acquired from one or more GPS satellites 5, the acquired time information display process is executed as in step S29 in the first embodiment.

However, if the time-out time is set to the second time (1 minute), the likelihood that positioning information and time information can be acquired from three or more GPS satellites 5 within the second time is low because the possibility that the GPS wristwatch 1 is indoors is strong.

Therefore, if the reception control unit 21 acquires time information from one or more GPS satellites 5, the acquired time information display process is executed as in step S29 in the first embodiment.

In addition, if positioning information and time information are acquired from three or more GPS satellites 5, the acquired position and time information display process is executed as in step S39 in the first embodiment.

When the reception process S63 ends, the reception control unit 21 ends reception control.

When power generation is low because the GPS wristwatch 1 is indoors, for example, this fourth embodiment of the invention can set the time-out time to a second time that is shorter than a first time because the time-out time setting unit 213 sets the time-out time according to the power generation state. As a result, the reception process will not continue for longer than the time-out time (second time) that is set when plural GPS satellites 5 cannot be captured, and and wasteful power consumption can be reduced.

On the other hand, because the time-out time is set to a first time that is longer than the second time when power generation is high, such as when the GPS wristwatch 1 is outdoor, there is a strong possibility that plural GPS satellites 5 can be captured and positioning information can be acquired, and the acquired position and time information display process can be executed.

The invention is obviously not limited to the foregoing embodiments.

For example, the first, third, and fourth embodiments are described executing the reception process automatically, but can obviously also be applied when the user manually initiates the reception process. More specifically, when the user manually initiates the reception process, operation can start from the evaluation process in step S12 in FIG. 5, FIG. 11, and FIG. 13.

Furthermore, the reception mode is selected by executing the evaluation process through steps S11 to S14 and S51 in the first, third, and fourth embodiments, but the reception mode may be selected using only the evaluation step S12 of determining if power generation is greater than or equal to the power generation threshold value, or the reception mode may be selected using only the evaluation process in step S13. More specifically, the invention selects and sets the reception mode or time-out time by executing a process of determining whether the GPS wristwatch 1 is located indoors or is located outdoor.

In addition, when S42 returns Yes in the second embodiment, the evaluation process of steps S13 and S14 in the first embodiment may be executed to select the reception mode.

Figure 14:
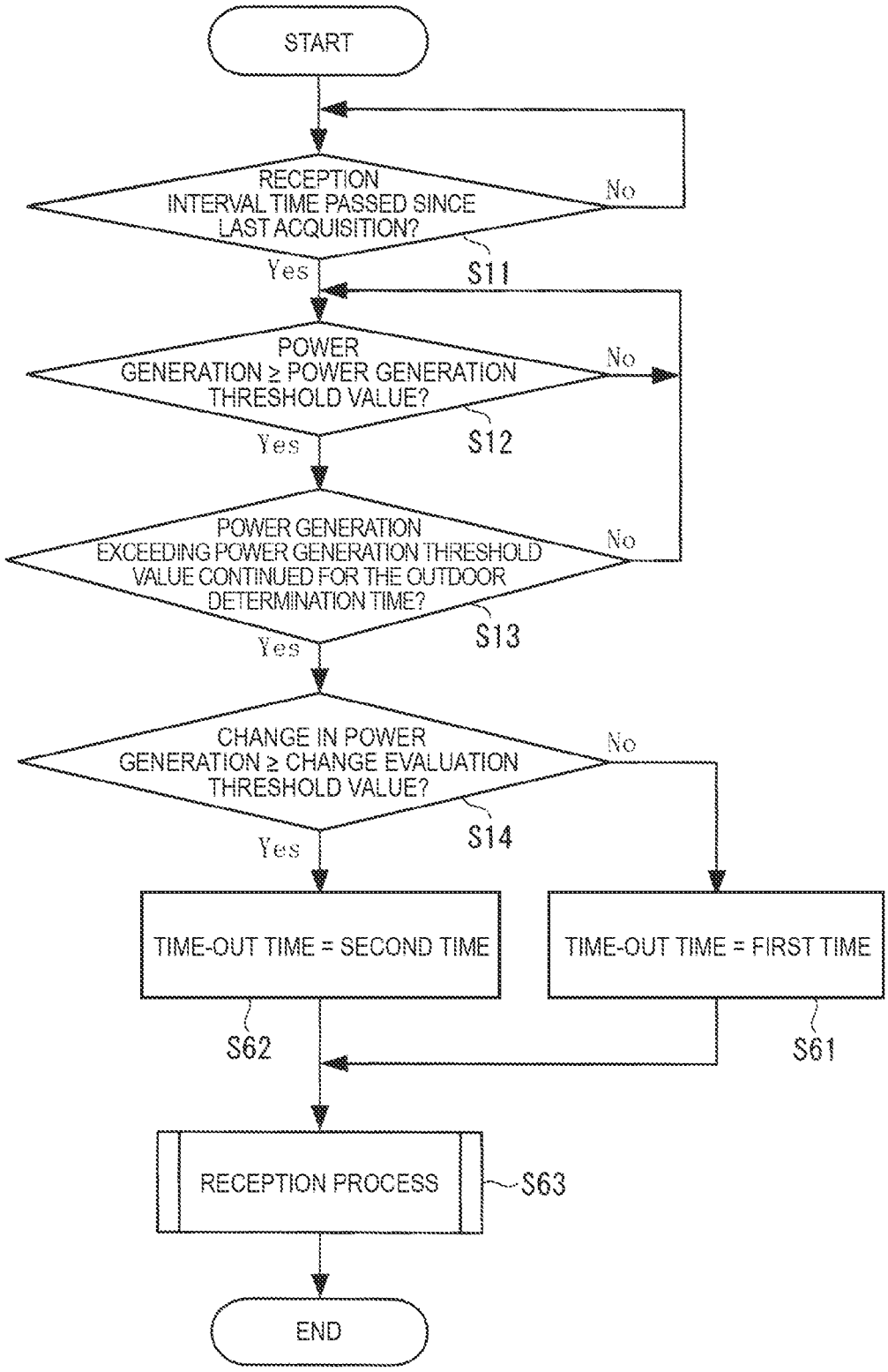
FIG. 14 is a flow chart describing the reception process in another variation of the invention.

The time-out time setting unit 213 is also not limited to setting the time-out time based on whether or not power generation is greater than or equal to a power generation evaluation threshold value as described in step S51 in the fourth embodiment. For example, similarly to the first embodiment as shown in FIG. 14, the time-out time setting unit 213 may set the time-out time to the second time if the change in power generation is greater than or equal to the change evaluation threshold value, and set the time-out time to the first time if the change in power generation is less than the change evaluation threshold value.

Yet further, similarly to the second embodiment, the time-out time setting unit 213 may set the time-out time to a first time if power generation is greater than or equal to a first power generation evaluation threshold value, set the time-out time to a second time if power generation is less than the first power generation evaluation threshold value and greater than or equal to a second power generation evaluation threshold value, and enable the user to set the time-out time if power generation is less than the second power generation evaluation threshold value.

An electronic device according to the invention is not limited to a GPS wristwatch 1, and the invention can obviously be applied in cell phones equipped with a GPS device, GPS navigation devices such as used when mountain climbing, and other types of devices.

The foregoing embodiments are described with reference to a GPS satellite 5 as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

Although the present invention has been described in connection with the preferred embodiments thereof with reference to the accompanying drawings, it is to be noted that various changes and modifications will be apparent to those skilled in the art in light of such disclosure. Any such changes or modifications are intended to be included within the scope of the present invention to the extent embodied in any claim of the present application.

What is claimed is:

1. An electronic device comprising:

a reception unit that captures a positioning information satellite and receives a satellite signal transmitted from the captured positioning information satellite;

a solar panel; and a reception control unit that controls the reception unit, the reception control unit including an evaluation unit that evaluates the reception environment based on power generation by the solar panel, and a mode selection unit that, based on the result from the evaluation unit, selects a time information reception mode for receiving the satellite signal and acquiring time information, or a position and time information reception mode for receiving the satellite signal and acquiring positioning information and time information, and controls operation of the reception unit in the reception mode selected by ode selection unit;

wherein the evaluation unit determines if power generation by the solar panel is greater than or equal to a first power generation evaluation threshold value, is less than a second power generation evaluation threshold value that is lower than the first power generation evaluation threshold value, or is less than the first power generation evaluation threshold value and greater than or equal to the second power generation evaluation threshold value; and wherein the mode selection unit selects the position and time information reception mode when the evaluation unit determines power generation is greater than or equal to the first power generation evaluation threshold value, selects the time information reception mode when the evaluation unit determines power generation is less than the first power generation evaluation threshold value and greater than or equal to the second power generation evaluation threshold value, and changes to a mode enabling the user to select the reception mode when the evaluation unit determines power generation is less than the second power generation evaluation threshold value.

2. An electronic device comprising:

a reception unit that captures a positioning information satellite and receives a satellite signal transmitted from the captured positioning information satellite;

a solar panel; and a reception control unit that controls the reception unit, the reception control unit including an evaluation unit that evaluates the reception environment based on power generation by the solar panel, and a mode selection unit that, based on the result from the evaluation unit, selects a time information reception mode for receiving the satellite signal and acquiring time information, or a position and time information reception mode for receiving the satellite signal and acquiring positioning information and time information, and controls operation of the reception unit in the reception mode selected by the mode selection unit;

wherein a time-out time is a time from a start of reception to a time at which reception is stopped without reception having succeeded, and wherein the reception control unit sets a first time-out time when the mode selection unit selects the time information reception mode and sets a second time-out time set when the position and time information reception mode is selected, the first time-out time being shorter than the second time-out time.

3. An electronic device, comprising:

a reception unit that captures a positioning information satellite and receives a satellite signal transmitted from the captured positioning information satellite;

a solar panel; and a reception control unit that controls the reception unit, the reception control unit including an evaluation unit that evaluates the reception environment based on power generation by the solar panel, and a time-out time setting unit that sets a time-out time based on the result from the evaluation unit, and causes the reception unit to stop and stops reception if the time-out time set by the time-out time setting unit is reached without reception succeeding after the reception unit is operated and reception started.

4. The electronic device described in claim 3, wherein:

the evaluation unit determines if power generation by the solar panel is greater than or equal to a power generation evaluation threshold value; and the time-out time setting unit sets the time-out time to a first time when the evaluation unit determines power generation is greater than or equal to the power generation evaluation threshold value, and sets the time-out time to a second time that is shorter than the first time when the evaluation unit determines power generation is less than the power generation evaluation threshold value.

5. The electronic device described in claim 3, wherein:

the evaluation unit monitors power generation by the solar panel for a specified change monitoring time, and determines if the change in power generation during the change monitoring time is greater than or equal to change evaluation threshold value; and the time-out time setting unit sets the time-out time to a first time when the evaluation unit determines that the change in power generation was less than the change evaluation threshold value, and sets the time-out time to a second time that is shorter than the first time when the evaluation unit determines that the change in power generation was greater than or equal to the change evaluation threshold value.

6. An electronic device comprising:

on unit that captures a positioning information satellite and receives a satellite signal transmitted from the captured positioning information satellite;

a solar panel; and a reception control unit that controls the reception unit, the reception control unit including an evaluation unit that evaluates the reception environment based on power generation by the solar panel, and a mode selection unit that, based on the result from the evaluation unit, selects a time information reception mode for receiving the satellite signal and acquiring time information, or a position and time information reception mode for receiving the satellite signal and acquiring positioning information and time information, and controls operation of the reception unit in the reception mode selected by the mode selection unit;

wherein the reception control unit operates the reception unit and starts the reception operation when power generation by the solar panel that is greater than or equal to a preset power generation threshold value has continued for at least a specified outdoor determination time.

7. An electronic device comprising:

a reception unit that captures a positioning information satellites and receives a satellite signal transmitted from the captured positioning information satellite;

a solar panel; and a reception control unit that controls the reception unit, the reception control unit including an evaluation unit that evaluates the reception environment based on power generation by the solar panel, and a mode selection unit that, based on the result from the evaluation unit, selects a time information reception mode for receiving the satellite signal and acquiring time information, or a position and time information reception mode for receiving the satellite signal and acquiring positioning information and time information, and controls operation of the reception unit in the reception mode selected by the mode selection unit;

wherein the reception control unit operates the reception unit and starts the reception operation when a user starts reception by a manual operation.

8. A satellite signal reception method for an electronic device having a reception unit that captures a positioning information satellite and receives a satellite signal transmitted from the captured positioning information satellite, a reception control unit that controls the reception unit, and a solar panel, the satellite signal reception method comprising:

evaluating the reception environment based on power generation by the solar panel;

selecting, based on the result from the evaluation unit, a time information reception mode for receiving the satellite signal and acquiring time information, or a position and time information reception mode for receiving the satellite signal and acquiring positioning information and time information; and controlling operation of the reception unit in the reception mode selected in the mode selection step;

wherein a time-out time is a time from a start of reception to a time at which reception is stopped without reception having succeeded, and wherein the reception control unit sets a first time-out time when the time information reception mode is selected and sets a second time-out set when the position and time information reception mode is selected, the first time-out time being shorter than the second time-out time.

9. A satellite signal reception method for an electronic device having a reception unit that captures a positioning information satellites and receives a satellite signal transmitted from the captured positioning information satellite, a reception control unit that controls the reception unit, and a solar panel, the satellite signal reception method comprising:

evaluating the reception environment based on power generation by the solar panel;

setting step of setting a time-out time based on the result from the evaluation step; and stopping the reception unit and ending reception if the time-out time set in the time-out time setting step is reached without reception succeeding after the reception unit is operated and reception started.

* * * * *